US007789162B2

(12) United States Patent
Keller et al.

(10) Patent No.: US 7,789,162 B2
(45) Date of Patent: Sep. 7, 2010

(54) METHOD FOR RUNNING TUBULARS IN WELLBORES

(75) Inventors: Stuart R. Keller, Houston, TX (US); John K. Montgomery, Houston, TX (US); Paul M. Spiecker, Manvel, TX (US); Bruce A. Dale, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 9 days.

(21) Appl. No.: 11/883,470

(22) PCT Filed: Feb. 3, 2006

(86) PCT No.: PCT/US2006/003887

§ 371 (c)(1),
(2), (4) Date: Jul. 31, 2007

(87) PCT Pub. No.: WO2006/101606

PCT Pub. Date: Sep. 28, 2006

(65) Prior Publication Data

US 2008/0115942 A1 May 22, 2008

Related U.S. Application Data

(60) Provisional application No. 60/664,110, filed on Mar. 22, 2005.

(51) Int. Cl.
*E21B 7/04* (2006.01)

(52) U.S. Cl. ..... 166/386; 166/313; 175/22; 175/61

(58) Field of Classification Search ..... None
See application file for complete search history.

(56) References Cited

U.S. PATENT DOCUMENTS 4,308,917 A 1/1982 Dismukes (Continued)

FOREIGN PATENT DOCUMENTS

EP 1 361 334 A1 11/2003

OTHER PUBLICATIONS

C. J. Mason et al., "Casing Running Challenges for Extended-Reach Wells", SPE 84447, SPE Annual Technical Conference, Oct. 5-8, 2003, 8 pages, Denver, Co.

(Continued)

*Primary Examiner*—Zakiya W. Bates
(74) *Attorney, Agent, or Firm*—ExxonMobil Upstream Research Company Law Department

(57) ABSTRACT

Methods for installing tubulars into a highly deviated wellbore may include a) drilling the well to the planned total depth of the interval, b) placing a first fluid into the wellbore below a prescribed measured depth in the high-angle portion of the wellbore, c) placing a second fluid into the wellbore above the prescribed measured depth, d) plugging the distal port ion of the tubular with a lower plug and an upper plug, e) as the tubular is run into the wellbore, placing a lightweight fluid into the plugged section of tubular and a heavy fluid above the plugged section of tubular, and f) running the tubular into the wellbore to the planned total depth. The first fluid has a density that causes the portion of the tubular that extends into the first fluid to become substantially neutrally buoyant, and the second fluid has a density less than the first fluid.

21 Claims, 6 Drawing Sheets

U.S. PATENT DOCUMENTS

| | | | |
|---|---|---|---|
| 4,384,616 | A | 5/1983 | Dellinger |
| 5,117,915 | A | 6/1992 | Mueller et al. |
| 5,181,571 | A | 1/1993 | Mueller et al. |
| 5,275,242 | A | 1/1994 | Payne |
| 6,328,107 | B1 | 12/2001 | Maus |
| 6,622,798 | B1 | 9/2003 | Rogers et al. |
| 2003/0034177 | A1 | 2/2003 | Chitwood et al. |
| 2003/0116324 | A1 | 6/2003 | Dawson et al. |
| 2004/0040749 | A1 | 3/2004 | Terry et al. |

OTHER PUBLICATIONS

G. Rae et al., "A New Approach for Running Production Casing from Semi-Submersible Rigs on Highly Deviated Wells", SPE/IADC 79814, SPE/IADC Drilling Conference, Feb. 19-21, 2003, 13 pages, Amsterdam, The Netherlands.

European Search Report No. 112485, dated Aug. 25, 2005, 5 pages.

METHOD FOR RUNNING TUBULARS IN WELLBORES

This application is the National Stage of International Application No. PCT/US06/03887 which claims the benefit of U.S. Provisional Application No. 60/664,110, which was filed on Mar. 22, 2005.

FIELD OF THE INVENTION

This invention relates generally to the field of well drilling and, in particular, to installation of casing or liners into oil and gas wellbores. Specifically, the invention is a method that enables running well tubulars into long and highly deviated wellbores.

BACKGROUND OF THE INVENTION

In developing oil and gas resources, it is often desirable to drill long, extended-reach ("ER") wells from a fixed drilling center such as a platform, pad, or subsea template. The ER wells allow distal parts of a field or distal reservoirs to be developed without having to construct a new wellbore or move the drilling center. The use of ER wells typically results in less cost, and may result in capture of oil and gas that would otherwise be uneconomic. The ER wells also have a number of other advantages, including less environmental impact and the ability to use existing infrastructure. In offshore environments, dry tree ER wells may also facilitate less costly workovers in comparison to subsea wells. The world record for reach (sometimes called throw) is currently about 11 kilometers (km), and this record was set in 1999.

In constructing ER wells, there often arises the need to run a tubular conduit, often referred to as a casing or liner, into the well. The tubular or conduit may also be referred to as a tubular pipe, tubing, string, or coiled tubing. The terms tubular, conduit or tubular conduit are equivalent and can be used interchangeably. In vertical or low-angle wells, the gravitational force acting on the casing or liner is usually sufficient to propel the pipe into the well. However, for horizontal or high-angle wells, because of the drag created by axial friction between the pipe and the wellbore, it may be impossible to run the casing or liner into the well using current practice. This is particularly true for wells with a high ratio of reach to total vertical depth ("TVD"). For such wells, the driving gravitational force pushing the casing or liner into the well may be less than the axial drag force resisting the motion of the casing or liner. The drag arises principally from the normal force between the casing and the wellbore wall and a friction coefficient that converts the normal force into an axial drag force. In high-angle wells, the normal force is high because a significant component of the weight of the pipe acts normal to the wellbore wall.

To overcome the drag acting on well tubulars being inserted into high-angle or ER wells, the oil and gas industry has devised a number of means of reducing the friction coefficient or reducing the normal force. For example, additives sometimes referred to as lubricants, can be placed in the drilling fluid to reduce the friction coefficient. In addition, casing/liner centralizers containing roller elements, sometimes referred to as roller centralizers, have been used to reduce the friction coefficient. However, none of the methods to reduce the friction coefficient can reduce the coefficient to zero. Thus, there is a limit on the length of casing or liner that can be run in high-angle wells using the friction reduction technology.

Another method to install pipe in ER wells is to simultaneously rotate the pipe while running it into the well. This method changes the direction of the velocity vector between the points of contact of the pipe and the wellbore wall. A non-axial velocity vector changes the direction of the frictional force so that less of the force acts in the axial direction opposing the running of the pipe. However, rotation is often limited by the torque capacity of the rig and/or the pipe connections. Also, since there is always some axial component of the frictional force, rotation cannot completely eliminate the axial drag. Thus, there is a limit on the length of casing or liner that can be run in a high-angle well using rotation.

Another method, often called casing or liner floatation, is sometimes used to facilitate installation of a casing or liner in a high-angle well. This method involves directly reducing the normal force acting between the casing or liner and the wellbore wall. Normally, as a casing or liner string is run into a wellbore, the casing or liner is filled with a liquid wherein the liquid often has a similar density as the external drilling fluid. The purpose of filling the casing or liner with the liquid is to help reduce the risk that the casing or liner will collapse as it is run deeper into the well. The casing/liner floatation method typically involves running a portion of the casing or liner that will line the high-angle part of the well empty or containing a lightweight fluid. The fluid being lightweight as compared to the external wellbore fluid. The internal lightweight fluid is typically air. The internal lightweight fluid reduces the effective weight per foot of the casing or liner and thereby reduces the normal force. Although this method is commonly called "floating" the casing or liner or casing or liner "floatation," the current practice is not to cause the casing or liner to become neutrally buoyant. See, for example, U.S. Pat. Nos. 5,117,915 and 5,181,571.

Neutral buoyancy is a state where a solid object submerged or partially submerged in a fluid experiences no net vertical force because the vertical component of the fluid-pressure-induced buoyant forces on the object exactly offset the vertical gravitational force or the weight, acting on the object. Most casing or liners are made from steel. It is typically not possible to cause the casing or liner to become neutrally buoyant by simply reducing the density of the internal fluid or even running the string with a gas inside. The reason for this is due to the high-density of steel with a specific gravity of approximately 7.8 and the geometry of casing or liner that is placed in the high-angle portion of the well. Therefore, there still typically exists a normal force between the casing and the wellbore when utilizing conventional technology since the casing or liner is not neutrally buoyant. This normal force creates a limit to the length of pipe that can be run in a high-angle well even using conventional casing floatation.

It is noted that some authors have suggested that neutral buoyancy can be achieved by adjusting the physical dimensions of the casing or liner. For example, in U.S. Pat. No. 5,181,571, it is suggested that the diameter and cross sectional [wall] thickness (and associated weight) of the pipe string can be adjusted to equal the weight of the displaced bore fluid. In most applications, this likely requires increasing the diameter of the casing or liner to increase the buoyant force acting on the pipe and/or decreasing the wall thickness to reduce the air weight per foot of the pipe. The reference cited does not specifically teach adjusting the external fluid to provide neutral buoyancy, but rather teaches adjusting the weight and size of the pipe string. Increasing the diameter of the casing or liner is often not feasible because the casing or liner has to fit through a previous casing string and into the borehole that has been drilled. Increasing the diameter and/or decreasing the wall thickness may also cause problems with satisfying other design requirements related to the collapse and burst resistance of the pipe string.

The casing/liner floatation method typically involves placing fluids having multiple densities inside the casing or liner. This is because it is desirable to have a low-density fluid in the casing or liner run into the high-angle portion of the well and a high-density fluid above a fixed plug inside the casing or liner in the low-angle portion of the well. The high-density fluid facilitates driving the string into the wellbore by increasing the gravitational force acting on the string. In using casing or liner floatation, typically the distal part of the string is filled with a lightweight fluid (or run empty) as the string is run into the wellbore. The float equipment (containing a check valve) prevents the heavier external mud from entering the string as it is run. After insertion of a desired amount of tubular filled with lightweight fluid into the wellbore, a second or proximal plug is placed within the tubular to trap the lightweight fluid in place. The length of lightweight-filled tubular can be several thousand meters (several thousand feet) depending upon the specific geometry of the borehole. The lightweight fluid reduces the effective weight per foot of the tubular in the high-angle part of the wellbore. The tubulars above the location of the proximal plug are used as an insertion string that is filled with a fluid typically more dense than the light fluid of the lower section. These tubulars can be additional casing or liner or pipe including, drill pipe. An illustrative example of this method is described in detail in U.S. Pat. No. 5,117,915.

While these existing methods can be effective in installing tubulars in some high-angle wellbores, there are limitations associated with the current practice. Specifically, since none of the current methods completely eliminate the axial friction force acting on the casing or liner in the high-angle portion of the well, there is a limit to the length of casing or liner that can be run into a high-angle well. This is typical for wells in which the reach to total vertical depth ratio is large with, for example, a ratio larger than 3. In such wells, the driving force to push the casing or liner into the well is small compared to the axial friction force opposing the motion of the casing or liner. Computer calculations indicate that, using conventional technology, the longest length of 69.94 kilogram/meter (kg/in) (47 pound/foot (lb/ft)) 0.24448 m (9⅝-inch) casing that can be run in a well with a TVD of 2000 meter (m) is about 11 km.

Another limitation of current practice is that the current casing floatation technique may increase the risk of collapsing the casing or liner. For instance, if the light fluid is a gas, for example, air, then by the conventional flotation method the pressure in the buoyed interval is essentially atmospheric. Further, gases at near-atmospheric pressure are very compressible. As such, the inserted tubular's resistance to collapse is essentially provided by the tubular alone. There is essentially no internal pressure to help counteract the external pressure that works to crush the tubular. If the fluid is a compressible liquid (such as oil or diesel), the pressure in the buoyed portion of the tubular will be above atmospheric pressure, but still below the in-wellbore pressure. As such, the inserted tubular's net collapse resistance is less than it would be if the tubular remained open and was filled with the same mud as is in the wellbore annulus. The net collapse resistance includes both the mechanical strength of the tubular wall and the internal pressure in the tubular. If the wall thickness is increased to improve collapse resistance, the drag on the tubular will also increase due to the greater weight per unit length.

Accordingly, there is a need for an improved tubular insertion methodology that allows an increase in the length of casing or liner that can be run into a high-angle well and reduce risk of tubular collapse. This invention satisfies that need.

SUMMARY OF THE INVENTION

In a first embodiment, a method for inserting a tubular into a wellbore is disclosed. The method comprises a) selecting an external tubular running fluid having a density, that reduces drag acting on a tubular to be run into at least one deviated portion of the wellbore, b) placing the external tubular-running fluid into at least a part of the deviated portion of the wellbore, c) running the tubular into the wellbore with a plug in the lower portion of the tubular that prevents the tubular running fluid from mixing with the fluid inside the tubular above the plug In a second embodiment, a method for inserting a conduit into a high-angle wellbore is disclosed. The method comprises a) placing a first fluid into the wellbore below a prescribed measured depth in the high-angle portion of the wellbore, the first fluid having a density that causes the portion of the casing or liner that extends into the first fluid to become substantially neutrally buoyant, b) placing a second fluid into the wellbore above the prescribed measured depth, the second fluid having a density less than the first fluid, c) plugging the distal portion of the conduit with a lower plug (or check valve) and an upper plug, d) as the conduit is run into the wellbore, placing a lightweight fluid into the plugged section of conduit and a heavy fluid above the plugged section of conduit, and e) running the conduit into the wellbore to the planned total depth.

A third embodiment further comprises a) installing a special circulation sleeve (differential valve (DV) tool) near the base of the vertical section of the prior casing string, b) opening the DV tool using either a drill-pipe conveyed opening tool, axial movement of the prior casing, or pressure applied to the prior casing annulus, c) as the conduit is run into the wellbore to the planned total depth, simultaneously circulating the second fluid down the annulus between the casing or liner being run and the existing wellbore, through the DV tool, and up the prior casing annulus and d) after the casing or liner is installed, closing the DV tool via drill string manipulation, axial movement of the prior casing, or pressure.

A fourth embodiment is disclosed. This embodiment comprises a) installing a special circulation pipe (parasite string) outside the previous casing with the distal end connected to the interior of the previously-installed casing near the base of the vertical section of the prior casing string, b) simultaneously circulating the second fluid down the annulus between the casing or liner being run and the existing wellbore, and up the parasite string (or in the reverse direction) as the conduit is run into the wellbore to the planned total depth, and c) after the casing or liner is installed, closing the parasite string via a shut-off valve (or a check valve).

A fifth embodiment is disclosed. This embodiment is a method associated with the production of hydrocarbons. The method includes selecting an external tubular running fluid and a lightweight fluid to have a density that causes a conduit extending into the external tubular running fluid to become substantially neutrally buoyant within the wellbore; disposing the external tubular running fluid into the wellbore; plugging a section of the conduit with a lower plug; disposing a lightweight fluid into the plugged section of the conduit; and running the conduit into the wellbore. Further, the method may include adjusting the external tubular running fluid and the lightweight fluid to maintain the density that causes the conduit extending into the external tubular running fluid to be substantially neutrally buoyant. Also, the method may include disposing another external tubular running fluid into the wellbore above a specific measured depth, the other external tubular running fluid having a density less than the external tubular running fluid.

A sixth embodiment is disclosed. This embodiment is a system associated with the production of hydrocarbons. The system includes a wellbore; a conduit disposed within the wellbore, an external tubular running fluid disposed within the wellbore, and a lightweight fluid. The conduit has a lower plug within a section of the conduit with the lightweight fluid disposed in the plugged section of the conduit. The external tubular running fluid and the lightweight fluid cause the conduit extending into the external tubular running fluid to become substantially neutrally buoyant. Further, the system may include an upper plug within the section of the conduit, wherein a heavy fluid is disposed above the plugged section of the conduit. Also, another external tubular running fluid may be disposed into the wellbore above a specific measured depth, the other external tubular running fluid having a density less than the external tubular running fluid.

BRIEF DESCRIPTION OF THE DRAWINGS

The present invention and its advantages will be better understood by referring to the following detailed description and the attached drawings in which.

DETAILED DESCRIPTION OF THE INVENTION

Figure 1:
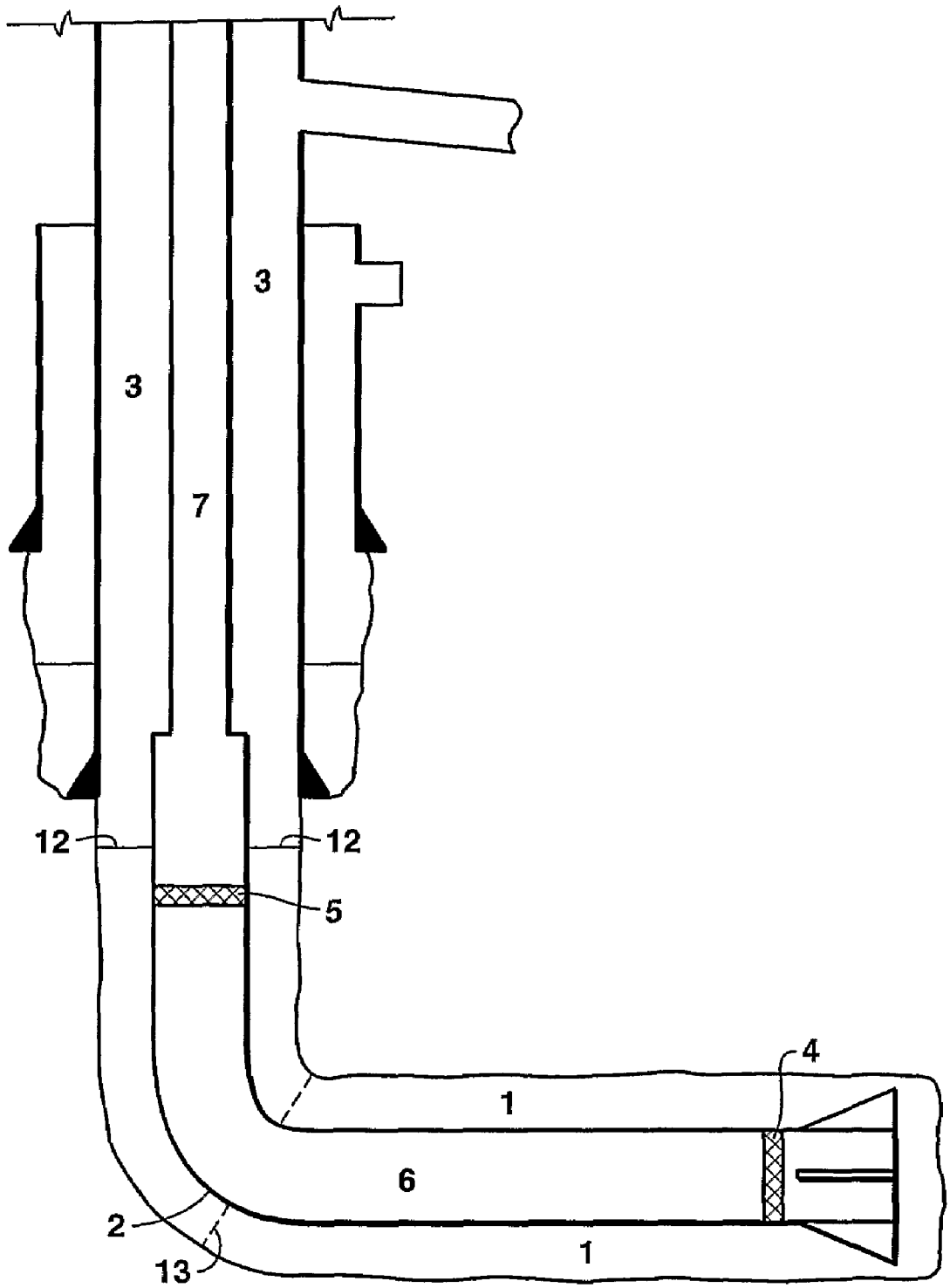
FIG. 1 is a cross sectional illustration of an embodiment of the current invention for conduit insertion wherein a light fluid is placed in the near vertical portion of the wellbore and a heavy fluid is placed in the high-angle portion of the wellbore.

The present invention will be described in connection with its preferred embodiments. However, to the extent that the following description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

This invention provides a method for buoyancy-aided insertion of a tubular into a long or high-angle wellbore by controlling the density of the external (annular) fluid. In one embodiment, the fluid density is controlled such that the tubular or conduit, including coiled tubing, is essentially neutrally buoyant in the high-angle portions of the wellbore and negatively buoyant in the low-angle portions of the wellbore. The process is further facilitated by using conventional casing floatation practice for the internal fluids. In addition, it may be possible to use a liquid rather than a gas inside the tubular conduit by adjusting the external fluid density to achieve less drag. In most instances the external fluid density would need to be increased to allow a liquid to be inserted in the tubular while maintaining a favorable buoyancy of the tubular. The use of liquids rather than a gas in a tubular decreases the risk of collapse because liquids are generally less compressible than gases.

An embodiment of the method for horizontal or high-angle wells provides the ability to adjust the external fluid density in the horizontal or high-angle portion of the well. The absolute hydrostatic pressure exerted by the external fluid does not substantially change by increasing the external fluid density. Thus, increasing the density of the external fluid in horizontal portions of the well will not entail any increased risk of casing collapse, lost returns, or well control problems.

In one embodiment of the method, it is also contemplated that the density of the external fluid in the low-angle portions of the well would be reduced to increase the net downward axial force acting on the inserted conduit. The nature of the buoyancy pressure forces acting on the conduit are such that reducing the external fluid density will increase the net axial force acting on the conduit, even in vertical portions of the wellbore. Note that adjustments to the external fluid density in the low-angle portions of the well will affect the absolute hydrostatic pressure exerted by the external fluid. Consequently, such adjustments should be made in a manner that honors other constraints including well control to avoid an influx of formation fluid. The need to honor these other constraints is well known to persons skilled in the art.

In a first embodiment, an external tubular running fluid is selected that has a density that reduces drag acting on a tubular to be run into at least one deviated portion of the wellbore. The external tubular-running fluid is placed into at least a part of the deviated portion of the wellbore. The tubular is run into the wellbore with a plug in the lower portion of the tubular that prevents the tubular running fluid from mixing with the fluid inside the tubular above the plug. Additional running fluids may be added as necessary to achieve a favorable density profile. In addition, a running fluid can be used that has a continuously variable density wherein the density variation is designed to achieve a favorable density profile.

One preferred embodiment comprises either utilizing an existing well or drilling a new well. A first fluid is placed into the wellbore below a prescribed measured depth in the high-angle portion of the wellbore. The first fluid having a density that cause the portion of the tubular (including casing, liners, conduits and any other equivalents) that extends into the first fluid to become substantially neutrally buoyant. A second fluid is placed into the wellbore above a determined depth, the second fluid having a density less than the first fluid. The distal portion of the tubular is plugged with a lower plug (or check valve) and an upper plug on the tubular. As the tubular is run into the wellbore, a lightweight fluid is placed into the plugged section of the tubular and a heavy fluid above the plugged section of tubular. The tubular is run into the wellbore to a planned total depth.

In this preferred embodiment, both the internal and the external fluid densities are adjusted to facilitate casing or liner running. Preferably, the external fluid is selected so that the casing or liner is substantially neutrally buoyant in the high-angle portion of the well. Conventional methods of casing floatation only adjust the internal fluid densities and do not attempt to achieve neutral buoyancy. Furthermore, conventional floatation practice including U.S. Pat. Nos. 5,117,915 and 5,181,571 do not attempt to adjust the external fluid density in the low-angle portion of the well to increase the downward driving force acting on the casing or liner.

A formula for calculating the approximate external mud weight to achieve neutral buoyancy for empty casing is given by:

$$NB_{enw}=K\times M_t/(D_c)^2 \quad (1)$$

wherein $NB_{enw}$ is the external mud weight for achieving neutral buoyancy in gram/liter (g/l) (pound/gallon (lb/gal));

K is a constant having the value 56,521,367 in metric units and 24.5 in oilfield English units;

$M_t$ is the mass per unit length of tubular in gram/meter (g/m) (lb/ft);

$D_c$ is the diameter of casing in meters (inches);

Note that if the casing or liner contains an internal fluid, the "mass per unit length of tubular in g/m (lb/ft)" in the above formula should be replaced by "mass per unit length of tubular and internal fluid in g/m (lb/ft)."

FIG. 1 illustrates the preferred embodiment of the current invention. First a well is obtained by either drilling the well to the planned total depth of the interval or using a preexisting wellbore. A first fluid 1 is placed into the wellbore below a chosen depth 13 in the high-angle portion of the wellbore. This first fluid has a density that will cause the portion of the casing or liner 2 that extends into the first fluid to become substantially neutrally buoyant. A second fluid 3 is placed into the wellbore above the chosen depth 13. The second fluid 3 has a density less than the first fluid 1. Typically, the distal portion of the casing or liner 2 is plugged with a lower plug (or check valves) 4 and an upper plug 5. As the conduit is run into the wellbore, a lightweight fluid 6 is placed into the plugged section of conduit and a heavy fluid 7 above the plugged section of conduit. The conduit is run into the wellbore to a desired depth. In the example shown in FIG. 1, the initial interface between the first fluid 1 and the second fluid 3 is at the chosen depth 13. After the conduit is run into the wellbore the interface would likely move to a less measured depth 12.

Figure 2B:
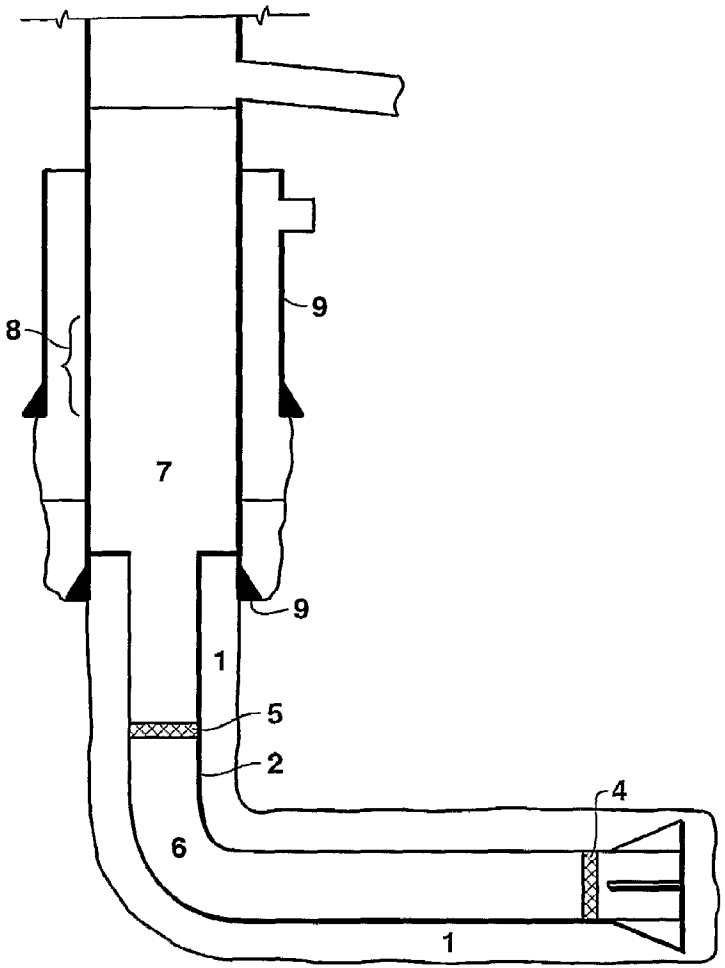
FIG. 2(*a*) and FIG. 2(*b*) are cross sectional illustration of a second embodiment of how a circulation sleeve can be utilized to control the annular fluid interface depth.
Figure 2A:
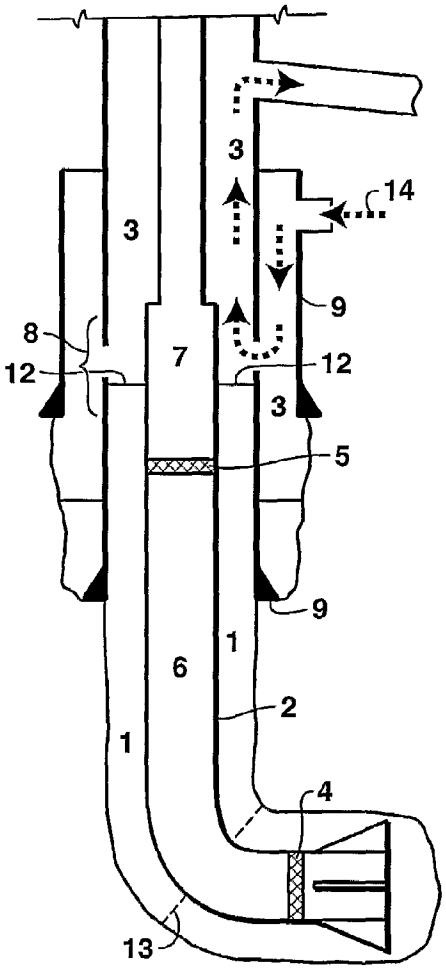

FIG. 2(*a*) and FIG. 2(*b*) illustrate another possible embodiment of the invention. In FIG. 2(*a*) and FIG. 2(*b*) substantially similar elements have been assigned the same reference numerals as in FIG. 1. This embodiment comprises installing a special circulation sleeve sometimes referred to as a differential valve (DV) tool 8 near the base of the vertical section of the prior casing string or previously-installed casing 9. A circulation sleeve is a device incorporated into a tubular string that has one or more ports that can be opened or closed by manipulating a sliding sleeve.

As shown in FIG. 2(*a*), a first fluid 1 is placed into the wellbore below a prescribed measured depth in the high-angle portion of the wellbore, the first fluid having a density that will cause the portion of the casing or liner 2 that extends into the first fluid to become substantially neutrally buoyant. A second fluid 3 is placed, into the wellbore above the chosen depth 13, the second fluid has a density less than said first fluid. The DV tool 8 is opened using either a drill-pipe conveyed opening tool, axial movement of the prior casing, or pressure applied to the prior casing annulus. The distal portion of the conduit is plugged with a lower plug (or check valve) 4 and an upper plug 5. As the conduit is run into the wellbore, a lightweight fluid 6 is placed into the plugged section of conduit and a heavy fluid 7 above the plugged section of conduit. The conduit is then run into the wellbore to the planned total depth. The second fluid 3 is simultaneously circulated down the annulus between the casing or liner being run and the existing wellbore, through the DV tool 8 as indicated by arrows 14. The fluid is typically run up the prior casing annulus but can be run in the reverse direction. As shown in FIG. 2(*b*), after the casing or liner is installed, the DV tool 8, such as a circulation sleeve, is typically closed via drill string manipulation and axial movement of the prior casing or pressure.

Figure 3:
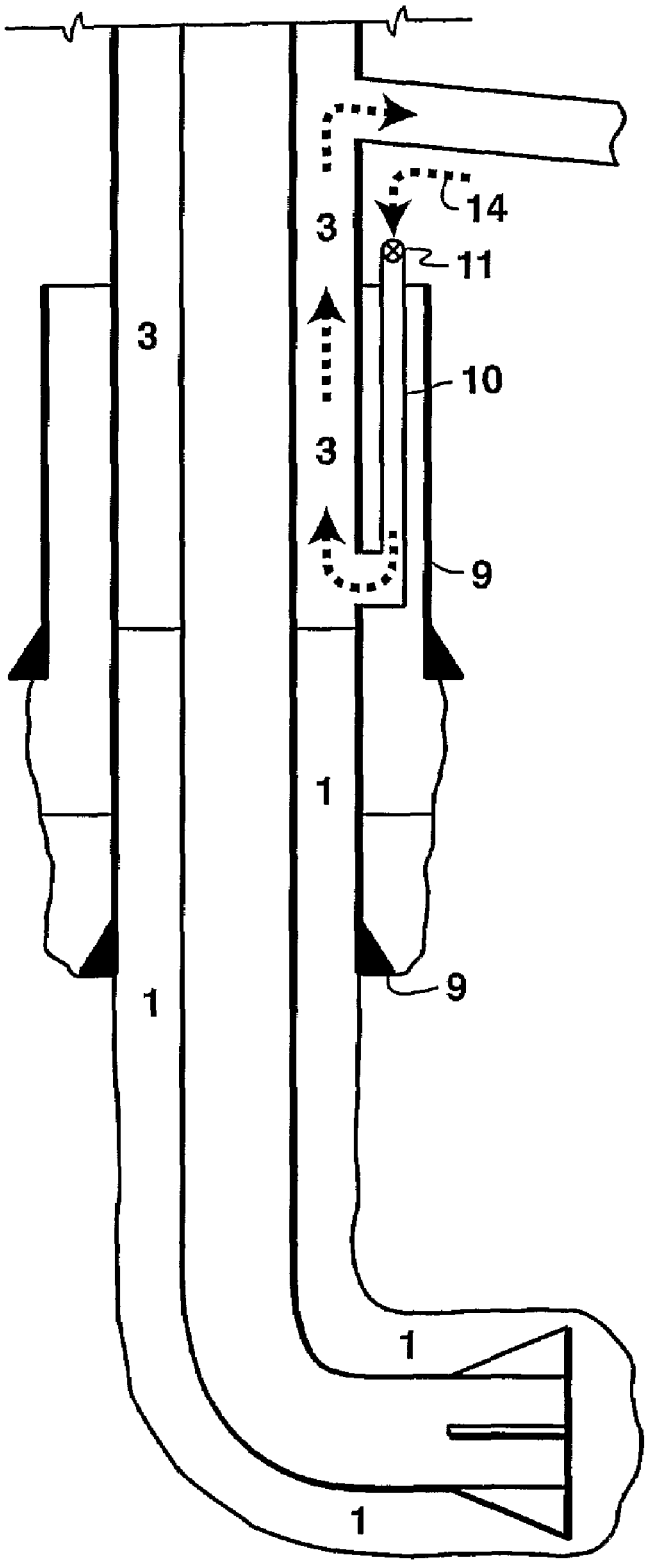
FIG. 3 is a cross sectional illustration of a third embodiment of the current invention where a parasite string is used to control the annular fluid interface depth.

FIG. 3 illustrates a third embodiment. In FIG. 3 substantially similar elements have been assigned the same reference numerals as in FIG. 2. This third embodiment comprises installing a special circulation pipe (parasite string) 10 outside the previously-installed casing 9 with the distal end connected to the interior of the previously-installed casing 9 near the base of the vertical section of the previously-installed casing 9.

In this embodiment, either a pre-existing well is utilized or the well is drilled to the planned total depth of the interval. A first fluid 1 is placed into the wellbore below a prescribed measured depth in the high-angle portion of the wellbore. The first fluid having a density that will cause the portion of the casing or liner that extends into the first fluid to become substantially neutrally buoyant. A second fluid 3 is placed into the wellbore above the prescribed measured depth. The second fluid having a density less than said first fluid. The distal portion of the conduit is plugged with a lower plug (or check valve) 4. As the conduit is run into the wellbore the upper plug is closed and a lightweight fluid 6 is placed into the plugged section of conduit and a heavy fluid 7 above the plugged section of conduit. The conduit is run into the wellbore to the planned total depth while simultaneously circulating the second fluid down the annulus between the casing or liner being run and the existing wellbore. The fluid is typically circulated up the parasite string 10 but may be circulated in the reverse direction. After the casing or liner is installed, the parasite string is closed. In this example, the parasite string is closed via a shut-off valve (or a check valve) 11.

Figure 4:
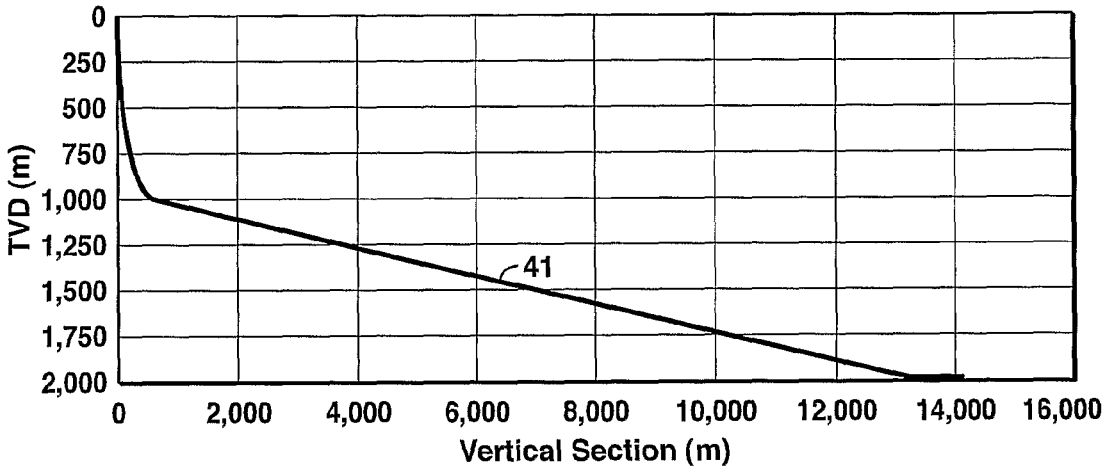
FIG. 4 shows an extended-reach well profile.
Figure 5:
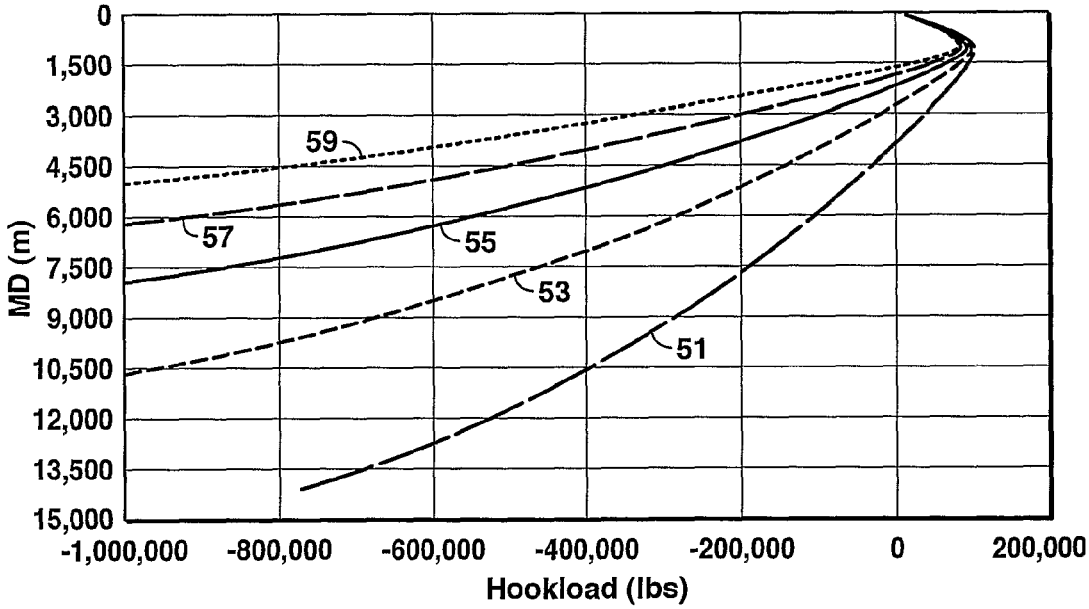
FIG. 5 shows the computer-calculated hook loads for multiple friction coefficients for running 69.94 Kg/M (47 lb/ft) 24.448 cm (9⅝-inch) casing with 1.321 g/cc (11 lb/gal) mud inside and out to a planned measured depth of 14,150 m (46,426 ft) in the well profile of FIG. 4.

FIGS. 4-8 provide the results of computer calculations further illustrating the concept for multiple friction coefficients. FIG. 4 illustrates an extended-reach well profile 41 having a total vertical depth of 2000 m and a throw of 14,150 m. FIG. 5 illustrates hook load profiles with friction coefficients of 0.30 51, 0.40 53, 0.50 55, 0.60 57, and 0.70 59, for running 69.94 kg/m (47 lb/ft) 24.448 centimeter (cm) (9⅝-inch) casing with 1.321 gram/cubic centimeter (g/cc) (11 lb/gal) mud inside and out to a planned measured depth of 14,150 m. The high negative hook loads indicate that for all the profiles the casing would not make it to the desired depth.

Figure 6:
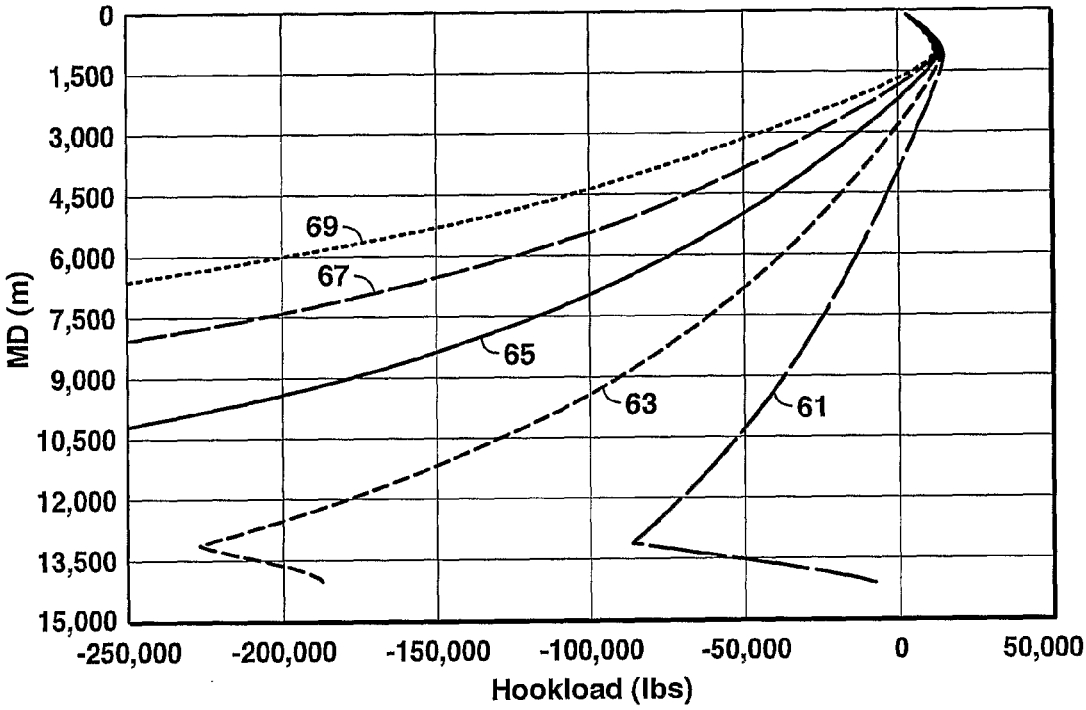
FIG. 6 shows hook loads for multiple friction coefficients for running the casing in 1.32 g/cc (11 lb/gal) mud with the majority of the casing empty, but with the top 1000 m (3,281 ft) of the casing filled with 1.32 g/cc (11 lb/gal) mud.
Figure 7:
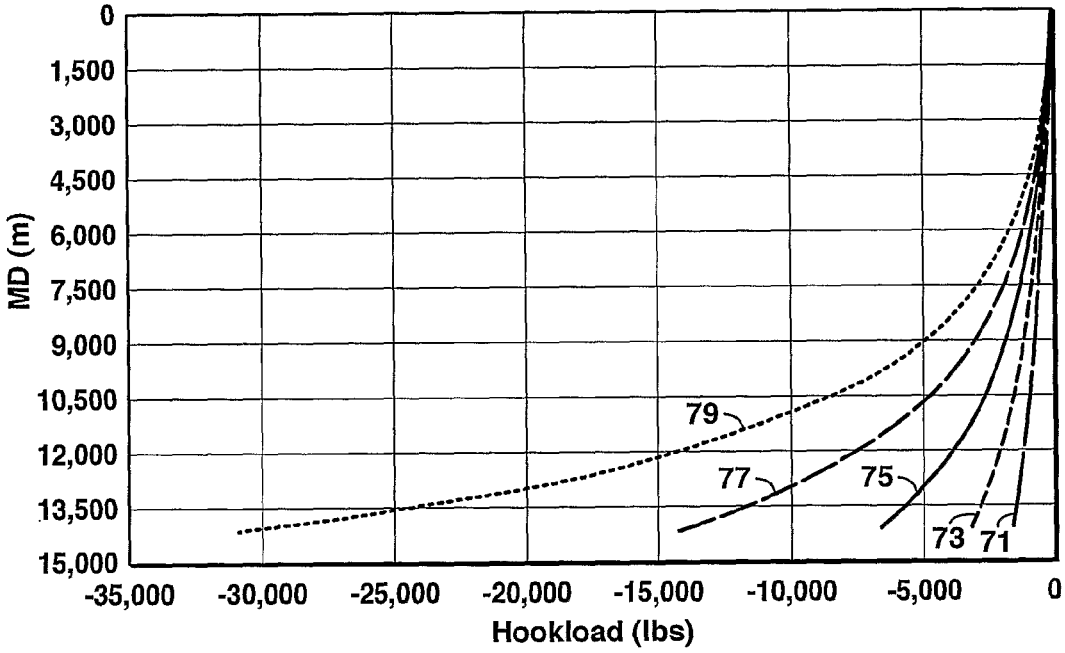
FIG. 7 shows hook loads for multiple friction coefficients for running the casing empty in a 1.489 g/cc (12.4 lb/gal) mud (the approximate mud density needed to achieve neutral buoyancy).
Figure 8:
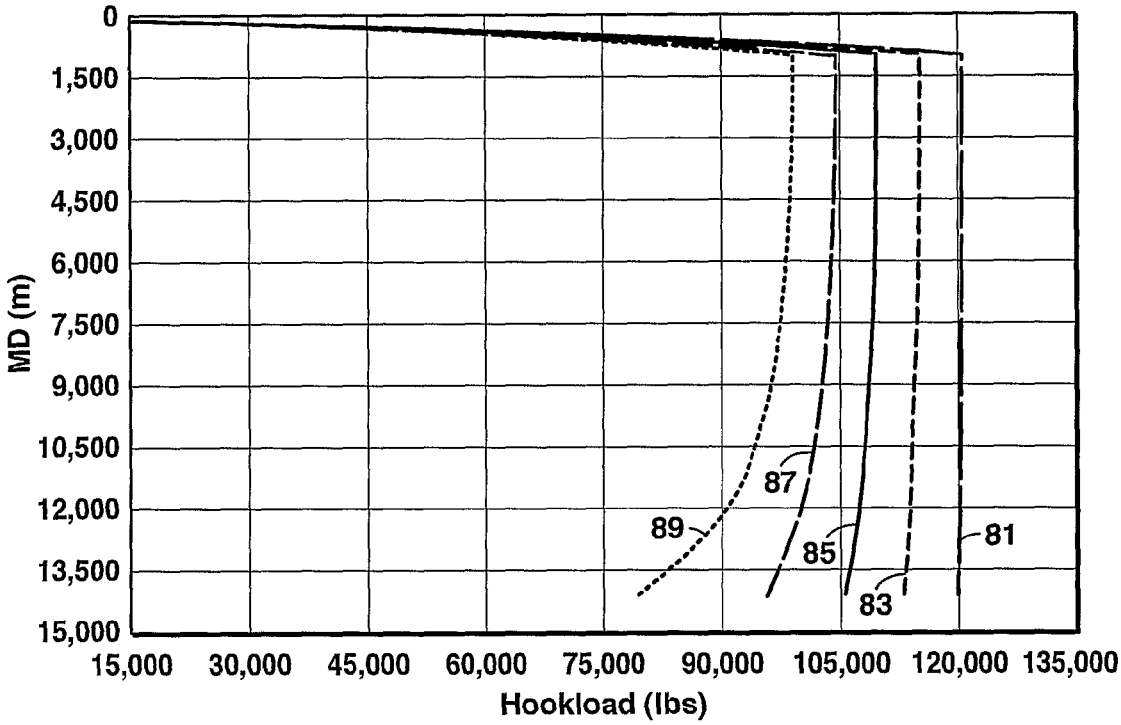
FIG. 8 shows hook loads for multiple friction coefficients for running the casing in a 1.489 g/cc (12.4 lb/gal) mud, but with the top 305 m (1000 ft) of the annulus filled with air.

FIG. 6 shows hook load with friction coefficients of 0.30 61, 0.40 63, 0.50 65, 0.60 67, and 0.70 69 for running the casing in 1.321 g/cc (11 lb/gal) mud with the majority of the casing empty, but with the top 1000 m of the casing filled with 1.321 g/cc (11 lb/gal) mud. This simulates conventional casing floatation as is currently practiced. Again, the negative hook loads indicate that the casing would not make it to the desired placement depth. FIG. 7 shows hook load profiles with friction coefficients of 0.30 71, 0.40 73, 0.50 75, 0.60 77, and 0.70 79 when running the casing empty in a 1.489 g/cc (12.4 lb/gal) mud (the approximate mud density needed to achieve neutral buoyancy). Here the casing would likely reach the desired placement depth with a small (less than 22,727 kg (50,000 lb)) push-down force from the rig at the surface. FIG. 8 shows the hook load profiles with friction coefficients of 0.30 81, 0.40 83, 0.50 85, 0.60 87, and 0.70 89 for running the casing in a 1.489 g/cc (12.4 lb/gal) mud, but with the top 308 m (1000 ft) of the annulus empty. For this scenario, the casing would reach the planned total depth without any push down force.

It should be noted that the lightweight fluid 6, which is discussed above, may be utilized to strengthen the liner 3. For instance, the lightweight fluid 6 may be a substantially incompressible fluid. The use of a substantially incompressible fluid inside the liner would greatly increase the resistance of the liner to collapse loads. As such, the process may be utilized in wellbores that experience forces that collapse other liners not having this substantially incompressible fluid.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What we claimed is:

1. A method for inserting a tubular into a wellbore, the method comprising:

a) selecting an external tubular running fluid having a density that reduces drag acting on a tubular to be run into at least one deviated portion of the wellbore, wherein the density of the external tubular running fluid is selected so that the tubular is locally substantially neutrally buoyant in at least part of the at least one deviated portion of the wellbore, b) placing the external tubular running fluid into the at least a part of the at least one deviated portion of the wellbore, c) placing a second fluid into the wellbore above the external tubular running fluid, the second fluid having a density less than the density of the external tubular running fluid; and d) running the tubular into the wellbore with a plug in the lower portion of the tubular that prevents the external tubular running fluid from mixing with fluid inside the tubular above the plug.

2. A method of claim 1, wherein the tubular contains a lightweight fluid in at least part of the at least one deviated portion of the wellbore, the lightweight fluid having a density lower than the external tubular running fluid density.

3. The method of claim 2, wherein the lightweight fluid is a substantially incompressible fluid.

4. The method of claim 2, wherein the tubular contains a heavy fluid in at least part of a low-angle portion of the wellbore, the heavy fluid having a density greater than the second fluid density.

5. The method of claim 1, wherein at least one port is placed in a previously run casing and is used to limit the height rise of the external tubular running fluid as the tubular is run into the wellbore.

6. The method of claim 1, wherein a small-diameter parallel tubular string placed in an annulus outside a previously installed casing string is used to control the height rise of the external tubular running fluid as the tubular is run into the well.

7. The method of claim 1, wherein the tubular is coiled tubing.

8. The method of claim 1, wherein the wellbore is a pipe or pipeline.

9. The method of claim 1 wherein the second fluid is selected to have a light density that increases the thrust of the conduit into the wellbore.

10. The method of claim 1 further comprising:

installing a circulation sleeve near a base of a vertical section of a prior casing string;

opening the circulation sleeve;

circulating the second fluid down an annulus between the tubular being run and the wellbore through the circulation sleeve; and closing the circulation sleeve after the is installed.

11. The method of claim 1 wherein the second fluid has a density designed to provide additional thrust.

12. A method for inserting a conduit into a high-angle wellbore, comprising:

a) placing a first fluid into the wellbore below a prescribed measured depth in a high-angle portion of the wellbore, the first fluid having a density that causes the portion of the conduit that extends into the first fluid to become substantially neutrally buoyant, b) placing a second fluid into the wellbore above the prescribed measured depth, the second fluid having a density less than the first fluid, c) plugging a distal portion of the conduit with a lower plug and an upper plug, d) placing a lightweight fluid into the plugged distal portion of the conduit and a heavy fluid above the plugged distal portion of the conduit as the conduit is run into the wellbore, e) running the conduit into the wellbore to a planned total depth.

13. The method of claim 12 further comprising:

a) installing a circulation sleeve near a base of a vertical section of a prior casing string, b) opening the circulation sleeve, c) circulating the second fluid down an annulus between the conduit being run and the existing wellbore, through the circulation sleeve, and d) closing the circulation sleeve after the conduit is installed.

14. The method of claim 12, wherein the first and second fluid densities are selected so that the conduit is locally substantially neutrally buoyant in at least a part of the high-angle portion of the wellbore.

15. The method of claim 12, wherein the conduit contains a lightweight fluid in at least part of the high-angle portion of the wellbore, the lightweight fluid having a density lower than the first fluid density.

16. The method of claim 12 wherein at least one port is placed in a previously run casing string is used to limit height rise of the first fluid as the conduit is run into the wellbore.

17. The method of claim 12 wherein a small-diameter parallel conduit string placed in an annulus outside a previously installed casing string and is used to control the height rise of the first fluid as the conduit is run into the wellbore.

18. The method of claim 12 wherein the conduit is coiled tubing.

19. The method of claim 12 wherein the wellbore is a pipe or pipeline.

20. The method of claim 12 wherein the first fluid has a density designed to reduce the drag by reducing side loads.

21. The method of claim 12 wherein the second fluid has a density designed to provide additional thrust.

* * * * *